United States Patent [19]

Coleman et al.

[11] Patent Number: 5,004,445

[45] Date of Patent: Apr. 2, 1991

[54] DOLLHOUSE WITHIN A DOLLHOUSE

[75] Inventors: Paula M. Coleman; Mark T. Luecke, both of Chicago, Ill.

[73] Assignee: Lewis Gallob Toys, Inc., South San Francisco, Calif.

[21] Appl. No.: 475,709

[22] Filed: Feb. 6, 1990

[51] Int. Cl.[5] ..... A63H 3/52

[52] U.S. Cl. ..... 446/478; 446/481; 446/482

[58] Field of Search ..... 446/478, 477, 476, 487, 446/75, 479–482, 268

[56] References Cited

U.S. PATENT DOCUMENTS 2,872,753 10/1959 Fenton ..... 446/478

3,363,360 1/1968 Ryan ..... 446/478

4,349,983 9/1982 Kilroy et al. ..... 446/75

FOREIGN PATENT DOCUMENTS 2159721 12/1985 United Kingdom ..... 446/487

*Primary Examiner*—Mickey Yu

[57] ABSTRACT

A toy in the shape of a dollhouse which can be opened to reveal a furnished house containing diminutive appliances, fixtures and furniture. Some of the diminutive applicances, fixtures and furniture may also be opened to reveal rooms having even more diminutive appliances, furniture and fixtures, with the decor of the rooms being related to the appliance, fixture or item of furniture which contains the room.

4 Claims, 1 Drawing Sheet

11
15
35
17
23

43
29
27
23
19
133
131
45
47
41
23
25
33
31
41
51
23
43
21

55
51
67
57
53
87

81
5
6
65
85
67
83
5
53
89
83
71
73
87
6
135
131
133

55
67
85
53
63
61
81
77
59
73
87

63
69
67
65
61
81
59
57
73

79
63
81
77
73

91
109
107
99
93
95
93
97
103
101
105

119
117
111
113
123
121

DOLLHOUSE WITHIN A DOLLHOUSE

BACKGROUND AND SUMMARY OF THE INVENTION

This invention is directed to an easily transportable, compact dollhouse that opens to expose an interior having diminutive appliances, fixtures and furniture, some of which appliances, fixtures and furniture can be removed from the dollhouse and opened to display rooms having even more diminutive appliances, fixtures and furniture, with the decor of the rooms having a relationship to the particular appliance, fixture or furniture which conceals and contains them.

An object of this invention is a miniature dollhouse made in at least two sections, which sections may be opened and closed relative to each other. When the dollhouse is closed, the interior furnishings and fixtures are concealed. In the open position of the dollhouse, the interior furnishings and fixtures are visible.

Another object of this invention is a dollhouse-sized replica of a piece of furniture, an appliance or a fixture which dollhouse-sized replica contains and conceals therein a replica of a room containing even smaller replicas of furniture, fixtures and appliances related to the dollhouse-sized replica.

Another object of this invention is a toy dollhouse in which the miniature appliances, furniture and fixtures contain and conceal even smaller displays of furniture and fixtures which can be opened for viewing.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figures 1, 2, 3, 4, 5, 6, 7, 8, 9:
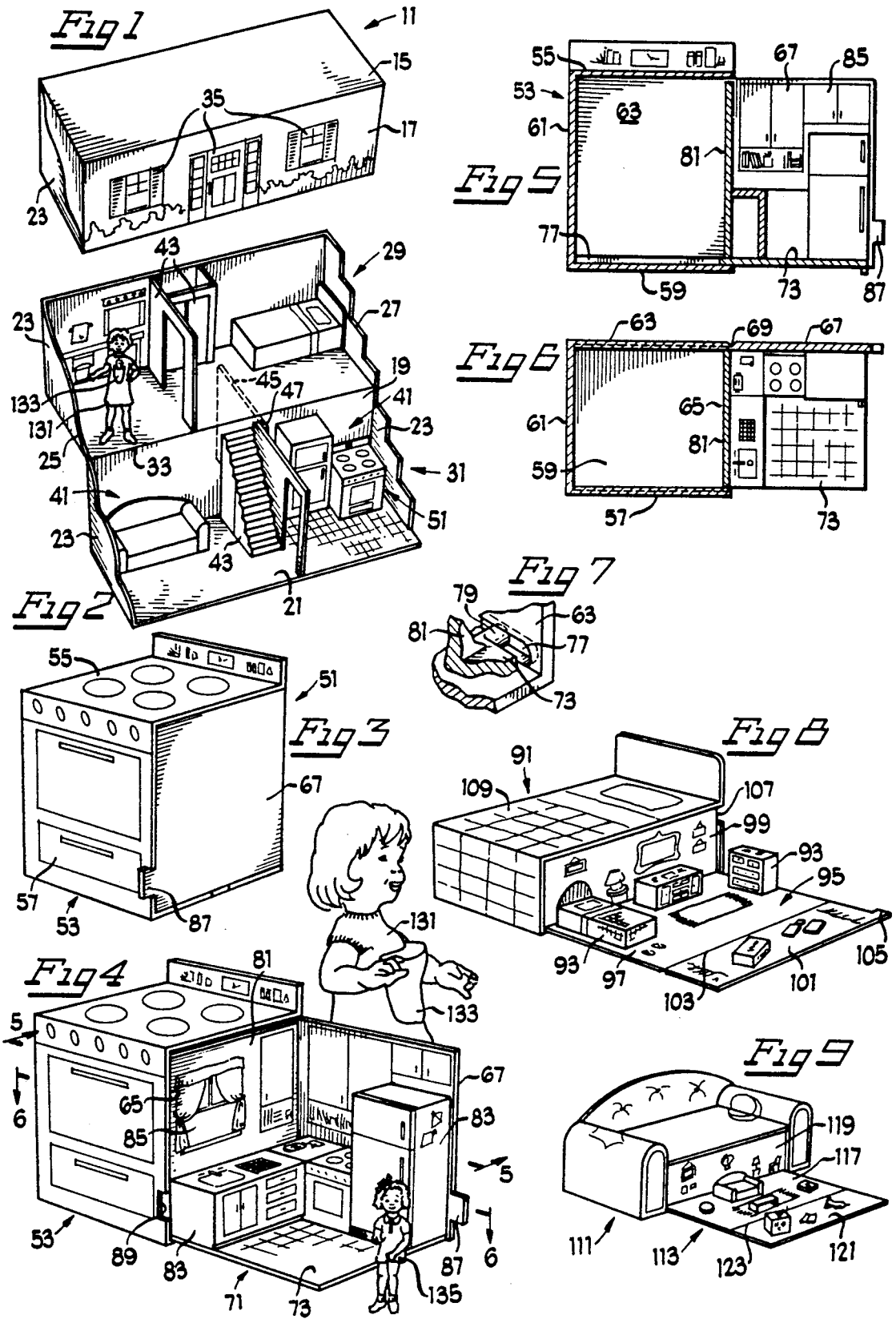
FIG. 1 is a perspective view of a dollhouse embodying the novel aspects of this invention, shown in its closed or transportable condition.
FIG. 2 is a perspective view of the dollhouse of FIG. 1, shown in its open or display condition.
FIG. 3 is an enlarged, perspective view of an appliance of the type shown in FIG. 2 of the drawings.
FIG. 4 is a perspective view of the appliance of FIG. 3 in its open position.
FIG. 5 is a view taken along line 5—5 of FIG. 4.
FIG. 6 is a view taken along line 6—6 of FIG. 4.
FIG. 7 is an enlarged, partial view of the slide stop mechanism shown in FIG. 5 of the drawings.
FIG. 8 is an enlarged, perspective view of a furniture piece shown in FIG. 2 in its open position.
FIG. 9 is an enlarged, perspective view of another piece of furniture of FIG. 2, shown in its open position.

FIG. 1 of the drawings shows a rectilinear container 11 of this invention in its closed or transportable condition and FIG. 2 shows it in its open condition. This container may be made of cardboard, plastic, metal or any suitable material for use by children. The container includes a top wall 15, a front wall 17, a rear wall 19, a bottom wall 21 and end walls 23. The end walls are divided along an undulating cut line 25 on one side and a stepped cut line 27 on the opposite side of the container, as shown in FIG. 2 of the drawings, to divide the container into a top section 29 and a bottom section 31.

The sections are connected by a hinge 33. Each wall of the container has inside and outside surfaces.

Decorative indicia 35, such as representations of windows, doors and shutters, are applied to the outer surface of the front wall 17 of the container 11 to give the container the appearance of a house. Supported on the interior surfaces of some of the walls of the container are three dimensional, diminutive furnishings 41 in the shapes of furniture, appliances, etc. The furniture and appliances may be removed for play outside of the container 11. There are also diminutive structural members 43, such as partitions, stairs and doors. One of the structural members is a partition 45 which is slidable through a cut out opening 47 in the rear wall 19 of the container 11 to support the top section 29 of the container when it is in its open position, shown in FIG. 2 of the drawings. This partition 45 is slid back into the container when the container is in its closed position, as shown in FIG. 1 of the drawings.

One of the furnishings 41 made in the shape of a cubical container 51 and decorated as a replica of a stove is shown in enlarged detail in FIGS. 3–6 of the drawings. This replica of a stove has an outer section 53 with a top wall 55, a front wall 57, a bottom wall 59, a side wall 61, a back wall 63 and an open side 65. The open side 65 is closed by a swinging side wall 67, which is connected by a hinge 69 to the back wall 63 of the container 51.

An inner section 71 slides into and out of the outer section 53 of the container 51 through the open side 65. The inner section has a bottom wall 73 which rests on and slides over the bottom wall 59 of the container 51. To guide the inner section 71 during its in and out movements, a horizontal slot 77 is formed in the back wall 63 of the outer section 53 and a stub 79 formed on the bottom wall extends through this slot, as shown in FIG. 7 of the drawings. The inner section 71 also has an interior wall 81 mounted on the bottom wall 73. Three dimensional replicas 83 of kitchen appliances are supported on the bottom wall 73. Decorative indicia 85 are formed on the interior surfaces of the interior wall 81 and the swinging side wall 67 to depict windows, curtains, cabinets, etc., normally found in a kitchen and which compliment the three dimensional replicas 83 of appliances. A tab 87 is formed on the swinging side wall 67 and it fits into a slot 89 formed in the front wall 57 of the container 51 to hold the door in its closed position. Thus, the replica 51 of a stove provides the child with a secret hiding place, concealing a kitchen which is a further development of the idea of a secret place found when the dollhouse container 11 is opened, revealing a fully furnished house.

In a similar manner, another one of the furnishings 41, in this case a cubical container 91 which is a replica of a bed, as shown in enlarged detail in FIG. 8, opens to depict miniature, three dimensional pieces of furniture 93. The furniture is mounted on an interior section 95 of the bed which slides out of the bed 91. The interior section consists of a floor 97, an interior end wall 99 and an exterior end wall 101 connected to the floor 97 by a hinge 103. The exterior end wall folds to become part of the floor when the interior section is slid out of the main container. The end wall 101 of the interior section has a tab 105 which fits into a slot 107 formed in one wall of the cubical container to secure the exterior end wall in its closed position. Decorative indicia 109 formed on the exterior surfaces of the container 91 give the container the appearance of a bed.

Another one of the fixtures 41 shown in FIG. 2 of the drawings is also shown in enlarged detail in FIG. 9; here a container 111 in the shape of a couch. An interior section 113 of this couch opens to reveal three dimensional furniture resembling the furniture of a living room. The interior section includes a floor section 117, an interior end wall 119 and an exterior end wall 121 which is connected to the floor by a hinge 123.

In each of the containers shown in FIGS. 8 and 9 of the drawings, again the child playing with the toy finds a secret place, another room hidden in one of the furnishings, which may also be hidden in the main container 11. This theme is further carried out by the doll 131 shown in FIG. 2 of the drawings. This doll includes a pocket 133 on its dress and, as shown in FIG. 4, this doll has a smaller doll 135 which is carried in the pocket 133 of its dress and is scaled to be compatible with the fixtures 83 shown in FIG. 4 of the drawings. In other words, the doll 131 is scaled so that it is proportional in size for play with the diminutive furnishings 41 while the smaller doll 135 is scaled so that it is sized for play with the smaller appliances, furniture and fixtures found inside the diminutive furnishings. 41.

We claim:

1. A toy sized for use with a dollhouse, said toy including:

a hollow container formed of at least two sections, said sections being connected to each other to permit said sections to be moved between open and closed positions relative to each other, means applied to the exterior of said hollow container to provide said container with the appearance of an appliance, a fixture or a piece of furniture that would be found in a house, means located in the interior of at least one section of said hollow container which means simulate on a small scale a room setting containing at least some of the appliances, fixtures and furnishings which would normally be found in the same type of room of a house as the appliance, fixture or piece of furniture whose appearance is shown on the exterior of said hollow container, said appliances, fixtures and furniture small scale simulating means being located in at least one of said sections so as to be concealed from view when the sections are moved to their closed positions relative to each other and to be visible in their conventionally oriented positions when the sections are moved to their open positions relative to each other.

2. A child's toy including:

a hollow container having walls with exterior and interior surfaces, means applied to said exterior surfaces of said walls to provide said container with the appearance of a diminutive house, said container being formed of at least two sections, said sections being connected to each other to permit said sections to be moved between open and closed positions relative to each other, means located in the interior of at least one section of said container, which means simulate on a small scale at least some appliances, furnishings and fixtures which would normally be found in a house of the type which is simulated by the container, at least some of said means which simulate on a small scale some appliances, furnishings and fixtures which would normally be found in a house are also containers which hold means which simulate on a smaller scale some appliances, furnishings and fixtures of a room in which said container would normally be found, with said smaller containers being movable between opened and closed positions in which the diminutive appliances, furnishings and fixtures are concealed int eh closed positions of the container and visible in the open positions thereof, said small scale appliances, furnishings and fixtures simulating means being positioned in at least one of said sections to be concealed from view when the sections are moved to their closed positions relative to each other and to be in their conventionally oriented positions when the sections are moved to their open positions relative to each other.

3. The child's toy of claim 2 further including a doll which is of the scale to be used with the container forming the diminutive house and a second doll which is of the scale of the smaller containers which simulate appliances, furnishings and fixtures of a room in which the smaller container would normally be found.

4. The child's toy of claim 1 further including a doll which is of the scale to be used with the container forming the diminutive house and a second doll which is of the scale of the smaller containers which simulate appliances, furnishings and fixtures of a room in which the smaller container would normally be found.

* * * * *